US007407366B2

(12) United States Patent
Hedlund et al.

(10) Patent No.: US 7,407,366 B2
(45) Date of Patent: Aug. 5, 2008

(54) PROPELLER COMBINATION FOR A BOAT PROPELLER DRIVE HAVING DOUBLE PROPELLERS

(75) Inventors: Benny Hedlund, Hono (SE); Kare Jonsson, Trollhattan (SE)

(73) Assignee: AB Volvo Penta, Gothenburg (SE)

( * ) Notice: Subject to any disclaimer, the term of this patent is extended or adjusted under 35 U.S.C. 154(b) by 19 days.

(21) Appl. No.: 11/162,134

(22) Filed: Aug. 30, 2005

(65) Prior Publication Data

US 2007/0098559 A1 May 3, 2007

Related U.S. Application Data

(63) Continuation of application No. PCT/SE2004/000206, filed on Feb. 17, 2004, now abandoned.

(30) Foreign Application Priority Data

Feb. 20, 2003 (SE) ..... 0300455

(51) Int. Cl.
*B64C 11/00* (2006.01)

(52) U.S. Cl. ..... 415/124; 415/198 R; 415/223 R

(58) Field of Classification Search ..... 416/198 R, 416/200 R, 124, 129, 223 R
See application file for complete search history.

(56) References Cited

U.S. PATENT DOCUMENTS

| | | | | | |
|---|---|---|---|---|---|
| 3,312,286 | A | * | 4/1967 | Irgens | 416/197 R |
| 3,514,215 | A | * | 5/1970 | Williams | 416/200 R |
| 4,632,636 | A | * | 12/1986 | Smith | 416/223 R |
| 4,741,670 | A | | 5/1988 | Brandt | |
| 4,789,306 | A | * | 12/1988 | Vorus et al. | 416/223 R |
| RE34,011 | E | | 7/1992 | Brandt | |
| 5,190,441 | A | * | 3/1993 | Murphy et al. | 416/129 |

* cited by examiner

*Primary Examiner*—Igor Kershteyn
(74) *Attorney, Agent, or Firm*—Novak Druce + Quigg LLP

(57) ABSTRACT

Propeller combination for an aft-mounted boat propeller drive unit with counter-rotating pushing propellers (8,9). The forward propeller (9) is made with blades (12) which have blade tips with an outer edge (b) which approaches a straight line. The width of the blade tip is between 40% and 45% of the maximum width of the blade.

8 Claims, 2 Drawing Sheets

PROPELLER COMBINATION FOR A BOAT PROPELLER DRIVE HAVING DOUBLE PROPELLERS

CROSS-REFERENCE TO RELATED APPLICATIONS

The present application is a continuation patent application of International Application No. PCT/SE2004/000206 filed 17 Feb. 2004 which was published in English pursuant to Article 21(2) of the Patent Cooperation Treaty, and which claims priority to Swedish Application No. 0300455-3 filed 20 Feb. 2003. Said applications are expressly incorporated herein by reference in their entireties.

FIELD OF THE INVENION

The present invention relates to a propeller combination for an aft-mounted boat propeller drive unit with pushing propellers, comprising a forward propeller and an after propeller designed to rotate simultaneously in opposite directions around a common rotational axis.

BACKGROUND OF THE INVENION

Such a propeller combination and a boat propeller drive unit of so-called inboard-outboard type having such a propeller combination is shown and described in SE 433599. Drive units of this type are common in planing motorboats of a length up to about 40 feet and for a speed range of 25-50 knots, where they provide, with few exceptions depending on boat type, higher efficiency and more rapid acceleration than corresponding single propeller drive units. Other advantages over known single propeller drive units are also achieved.

The individual propellers in this known propeller combination are dimensioned to provide essentially equal pressure force and in order to achieve approximately the same security against cavitation, the propellers are dimensioned with approximately the same total blade area. Despite this the blades of the after (aft) propeller, after operating for an extended period, have at times been subjected to degradation, particularly on the pressure side, to a greater extent than the forward propellers.

SUMMARY OF THE INVENION

A general purpose of the present invention is to solve these problems and achieve such a propeller combination of the type described and in which the after propeller is not subjected to a greater risk of degradation due to cavitation than is the forward propeller.

This is achieved according to the invention by virtue of the fact that the blade of the forward propeller has a curved front edge and a curved rear edge, which join, via distinct transitions, a blade tip with an outer edge which, in flattened projection has a greater radius of curvature than the radii of curvature of the front edge and the rear edge in the blade portion radially outside the blade profile section of maximum blade width.

A propeller of this design has been shown to operate without, or with only insignificant suction side cavitation in the normal operating point of the propeller combination.

The invention is based on the insight that if the forward propeller operates with sheet cavitation on the suction side then the after propeller will thus be forced to cut through this sheet cavitation from the forward propeller. Further, the cavitation bubbles from the suction side of the forward propeller will implode where the pressure is highest, namely on the pressure side of the after propeller—a condition that can eventually lead to degradation of the after propeller.

The reasons for the suction side cavitation on the forward propeller are primarily high engine power and high boat speed, and that the propellers are operating in a non-homogenous flow field behind the drive unit leg. The degree of cavitation on the suction side of the forward propeller can of course, in accordance with prevailing design principles, be reduced by making the propeller with a relatively large blade surface, which will, however, in practice lead to an disproportionately large blade surface that in turn gives rise to technical problems in the manufacture of these blades that are either completely, or at least partially overlapping one another.

According to the invention, it has been discovered that if, instead of making the propeller with an unproportionally large blade surface, one merely makes the top of the blades with a shape that geometrically deviates to only a limited extent from the presently accepted shape of the blade tips of the propeller, and this will result in a forward propeller which operates without, or with minimal string cavity from the blade tip in the normal operating point of the propeller combination. This in turn reduces the amount of cavitation on the suction side of the forward propeller. The normal operating point is the operating point where the propeller combination extracts the maximum power and provides maximum speed at a given rpm.

It has proved sufficient to broaden the blade tip somewhat rotationally, as compared to a corresponding propeller with blade tips designed according to accepted practice, without increasing the maximum diameter of the propeller, and by straightening out the forward edge and the rear edge somewhat to connect to the outer edge of the blade tip in order for the propeller to operate essentially without suction side cavitation at its normal operating point. The increase in blade surface resulting therefrom is negligible compared to the surface of a corresponding conventional propeller and thus does not lead to any technical production problem.

A radial circulation distribution with an unloaded blade root and blade tip and with the described blade tip design according to the invention will significantly reduce intermittent suction cavitation and particularly sheet cavitation caused by a non-homogenous flow field, and therefore erosion cavitation on the pressure side of the aft propeller is avoided. If, however, the forward propeller operates with the blade tip and blade root too unloaded, the propeller combination will have low efficiency and increasing risk of cavitation degradation to the pressure side of the forward propeller. The design of the invention provides a balanced unloading so that the propeller efficiency is essentially maintained at the same time as cavitation erosion to the aft propeller is avoided.

BRIEF DESCRIPTION OF THE DRAWINGS

The invention will now be described in greater detail with reference to the exemplary embodiments shown in the accompanying drawings, wherein.

DETAILED DESCRIPTION

Figure 1:
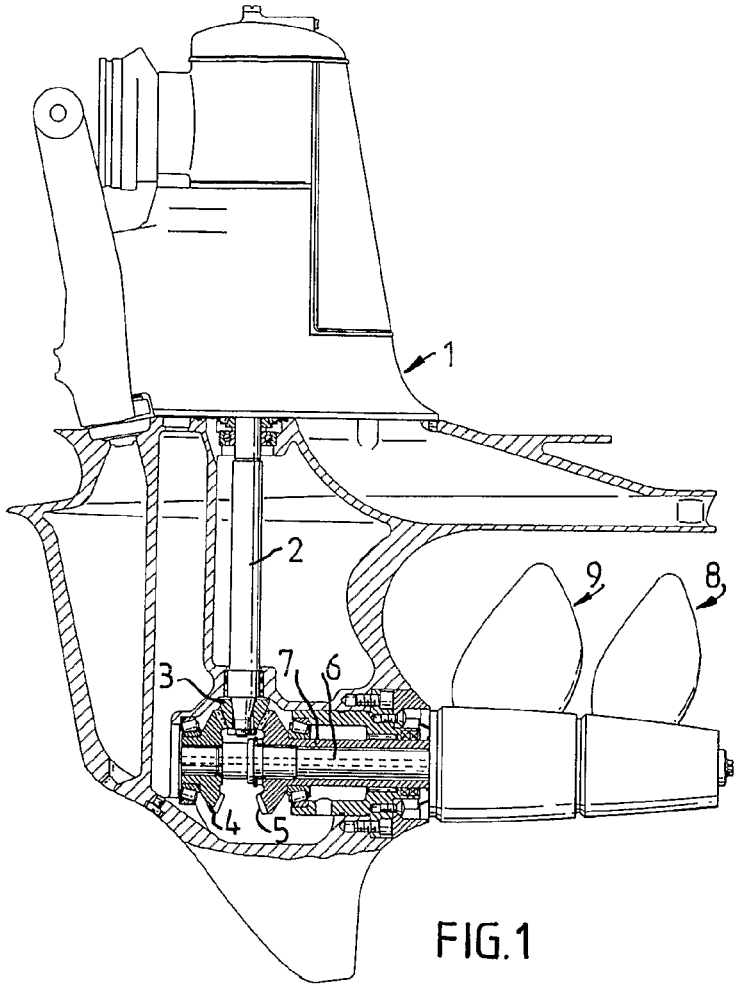
FIG. 1 is a partial cross-sectional side view of an outboard drive unit with a propeller combination that is configured according to the present invention.

The propeller drive unit, generally designated 1 in FIG. 1, is a so-called inboard-outboard drive, intended to be mounted on the transom of a boat and coupled to the output shaft of an engine (not shown). The drive unit has a reversing mechanism with an output shaft 2 having a bevel gear 3 in constant engagement with two bevel gears 4 and 5. The bevel gear 4 drives a propeller shaft 6 and gear 5 drives a hollow propeller shaft 7 concentrically mounted around shaft 6. The shaft 6 carries a propeller 8 and the shaft 7 carries a propeller 9. The propeller shafts will rotate in opposite directions, and the rotational direction of the shaft 2 is selected so that the shaft 7 will rotate counter-clockwise as seen from behind.

Figure 4:
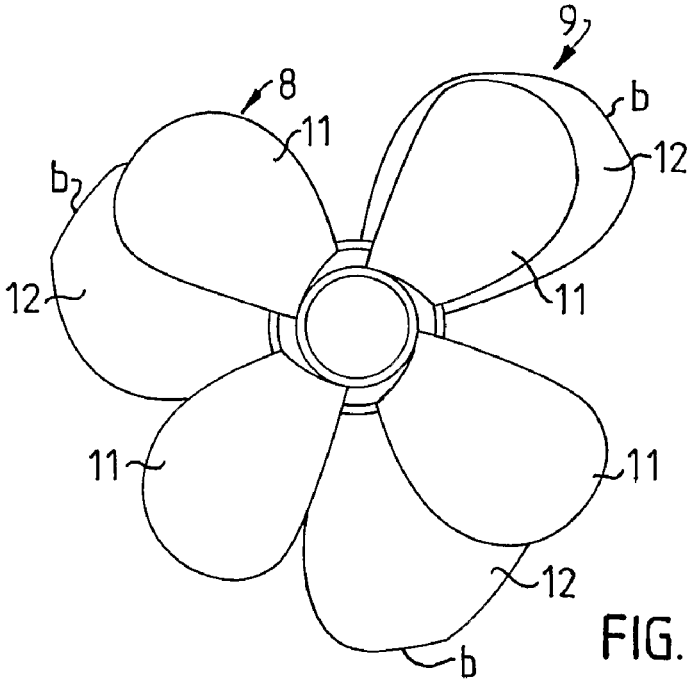
FIG. 4 is an elevational view, from behind, of one embodiment of a propeller combination configured according to the invention.

As is most clearly evident from FIG. 4, the forward propeller 9 is of greater diameter than the after propeller 8 and for this reason the latter will lie well inside the flow tube generated by the propellers. In the embodiment shown in FIG. 1, the diameter of the after propeller 8 is 95% of the diameter of the forward propeller, but, depending on various factors such as degree of load, the after propeller can have a diameter which is between about 85-95% of the diameter of the forward propeller. Furthermore, it is evident that the after propeller 8 in the embodiment shown has four blades 11, while the forward propeller 9 has three blades 12. The blade width of the after propeller 8 can be 75-85% of the blade width of the forward propeller, and in the embodiment shown, it is about 75% of the blade width of the forward propeller 9. The after propeller 8 can have approximately the same pitch as the forward propeller 9 and has a pitch maximum which lies on a radius which is 20-25% greater than the radius of the pitch maximum of the forward propeller.

Figure 2:
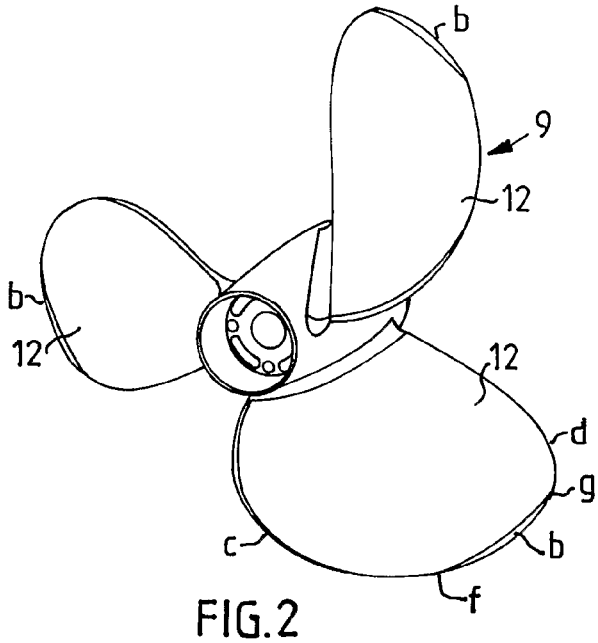
FIG. 2 is a perspective view of one embodiment of a forward propeller of the propeller combination.
Figure 3:
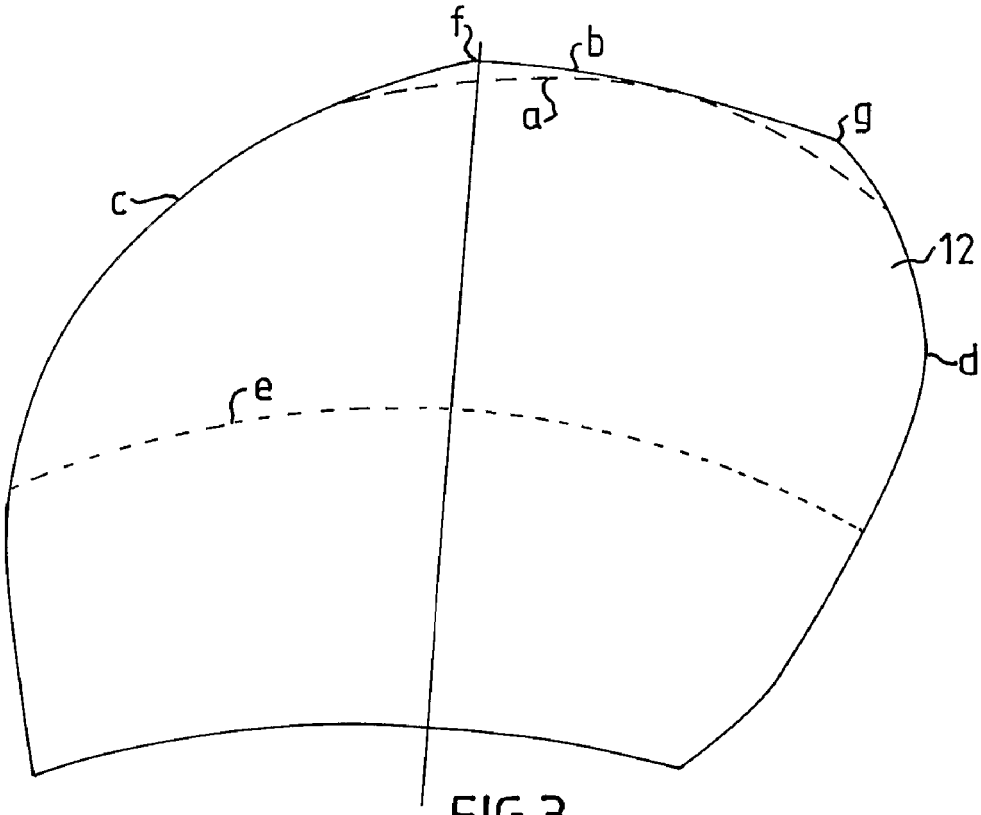
FIG. 3 is a flattened projection of a propeller blade of the propeller depicted in FIG. 3.

As can be seen in FIGS. 2-4, the blades 12 of the forward propeller 9 are made with blade tips of different geometric shape than the softly rounded shape commonly accepted in current design practice, and the blades also lack pronounced transitions between the front and rear edges of the blade and the edge of the blade tip itself and which are characteristic for propellers of double propeller drive units in motor boats of the described type.

This difference is particularly evident in the flattened projection shown in FIG. 3 of the forward propeller blade 12, shown in its entirety with the solid line. The difference in shape in comparison with a conventional propeller is marked with the dashed line "a". The forward propeller 12, according to the invention, has a blade tip with a marked out edge "b" which, in the embodiment shown, has a slight curvature and thus almost approaches a straight line in its extended projection. In other words, the outer edge "b" has a radius of curvature which is substantially greater than the radius of curvature of the portion of the blade front edge "c" and blade rear edge "d" lying radially outside the blade profile section "e" of greatest width (cord length).

The front edge "c" and the rear edge "d" of the blade join via pronounced transitions "f" and "g" the outer edge "b". In the embodiment shown, the transitions are sharp, but they can be slightly beveled without affecting the function.

Tests have shown that the outer edge "b" (the profile section at the blade tip) should have a width (cord length) which is 40-45% of the width (cord length) of the blade profile section "e" to obtain best results.

It should be pointed out, however, that the modification described in accordance with the invention does not involve any radial extension of the blades in comparison with the blades of a corresponding conventional propeller; this is most evident in FIG. 3. The increase in surface area of the new propeller blades, in comparison with conventional blades, is thus limited to the two surface portions outside the dashed line "a". Moreover, these differences are so small that they do not cause any technical production problems or increased costs.

The propeller combination shown in FIG. 4 consists of a three-bladed forward propeller and a four-bladed after propeller, but it should be understood that the invention is not limited to only just this design. Rather, the forward propeller in view of the above characterizations can of course also be implemented with an after propeller which has the same number of blades as the forward propeller.

What is claimed is:

1. A propeller combination for an aft-mounted boat propeller drive unit with pushing propellers, said propeller combination comprising:

a multi-blade forward boat propeller (9) and a multi-blade after boat propeller (8), said boat propellers rotating in opposite directions about a common rotational axis during operation; and at least one blade (12) of the forward boat propeller (9) has a curved front edge (c) and a curved rear edge (d), which join, via distinct transitions (f, g), a blade tip with an outer edge (b) which in flattened projection has a greater radius of curvature than the radii of curvature of the front edge and the rear edge in the blade portion radially outside the blade profile section (e) of maximum blade width.

2. The propeller combination as recited in claim 1, wherein said outer edge (b), in flattened projection, is approximately defined by a straight line.

3. The propeller combination as recited in claim 1, wherein blade profile sections at the blade tip (b) have a width which is approximately forty to forty-five percent of the blade section (e) of maximum blade width.

4. The propeller combination as recited in claim 1, wherein said after propeller (8) has approximately the same width as the forward propeller and a pitch maximum which lies at a radius which is approximately twenty to twenty-five percent greater than the radius for the pitch maximum of the forward propeller (9).

5. The propeller combination as recited in claim 1, wherein said forward and after propellers have the same number of blades.

6. The propeller combination as recited in claim 1, wherein said forward and after propellers (9,8) have different numbers of blades.

7. The propeller combination as recited in claim 1, wherein both boat propellers (8,9) are configured to operate essentially free of cavitation at a normal operating point.

8. The propeller combination as recited in claim 1, wherein said curved front edge (c) is convex in flat projection and said curved rear edge (d) is convex in flat projection.

* * * * *